United States Patent [19]

Curtin et al.

[11] Patent Number: 4,676,849

[45] Date of Patent: Jun. 30, 1987

[54] GAS BUBBLE-SENSITIZED EXPLOSIVE COMPOSITIONS

[75] Inventors: David J. Curtin, South Oakleigh; David E. Yates, East Brunswick, both of Australia

[73] Assignee: ICI Australia Limited, Victoria, Australia

[21] Appl. No.: 910,222

[22] PCT Filed: Dec. 11, 1985

[86] PCT No.: PCT/AU85/00299

§ 371 Date: Aug. 11, 1986

§ 102(e) Date: Aug. 11, 1986

[87] PCT Pub. No.: WO86/03483

PCT Pub. Date: Jun. 19, 1986

[30] Foreign Application Priority Data

Dec. 11, 1984 [AU] Australia ..... PG8517

[51] Int. Cl.[4] ..... C06B 45/00

[52] U.S. Cl. ..... 149/2; 149/21; 149/45; 149/92; 149/109.6

[58] Field of Search ..... 149/2, 21, 45, 92, 109.6

[56] References Cited

U.S. PATENT DOCUMENTS 3,814,694 6/1974 Klager et al. ..... 252/186
3,886,010 5/1975 Thornley et al. ..... 149/2
3,995,673 12/1976 Grigaitis et al. ..... 149/2
4,008,108 2/1977 Chrisp ..... 149/2
4,303,731 12/1981 Torobin ..... 149/2
4,594,118 6/1986 Curtin et al. ..... 149/2

FOREIGN PATENT DOCUMENTS 37165 11/1968 Australia .
44671 1/1982 European Pat. Off. .

*Primary Examiner*—Stephen J. Lechert, Jr.
*Attorney, Agent, or Firm*—Cushman, Darby & Cushman

[57] ABSTRACT

This invention relates to the preparation of gas bubble-sensitized explosive compositions which are liquid during their manufacture.

It is possible to achieve particularly fine bubble sizes and therefore enhanced explosive power by incorporating in the liquid composition a gas bubble-generating agent (either a gas or a substance capable of generating gas) prior to subjecting, or while the composition is subjected, to super-atmospheric pressure, this pressure being sufficient to dissolve at least part (preferably all) of any gas present. The composition is returned rapidly to atmospheric pressure and this creates a fine discontinuous gaseous phase in the composition.

The invention is especially useful for preparing emulsion explosives which can be mixed and pumped under pressure, thus substantially avoiding gas bubble disengagement and coalescence.

39 Claims, 2 Drawing Figures

GAS BUBBLE-SENSITIZED EXPLOSIVE COMPOSITIONS

This invention relates to explosive compositions, and more particularly to a method of manufacture of gas bubble-sensitized explosive compositions which are liquid when they are prepared.

Many explosive compositions are liquid during their manufacture; these include not only the aqueous emulsion and slurry explosives much used for blasting, but also various types of melts, wherein the manufacture is performed on a liquid phase but the end product is solid.

A widely-used means of reducing density and sensitizing explosive compositions is by the incorporation of gas bubbles. This has generally been achieved either by the addition of pre-encapsulated gas, for example, in the form of glass microballoons, or by the direct incorporation of gas. The latter method can be carried out by, for example, mechanical agitation, injection, bubbling the gas through the composition, or by in situ generation of gas by chemical means. The incorporation of gas bubbles in an aqueous emulsion by the in situ chemical generation of gas as a result of the decomposition of a foaming agent therein is described for example in U.S. Pat. Nos. 3,706,607, 3,711,345, 3,713,919, 3,770,522, 3,790,415 and 4,008,108.

In practice, pumping or mixing gas bubble-sensitized liquid explosive compositions can lead to bubble coalescence and bubble disengagement, and thus to reduced performance of the compositions. There have been suggested from time to time means for overcoming these disadvantages. For example, in the commercially very important emulsion explosives field, U.S. Pat. No. 4,008,108 describes a method in which pumping or mixing is finished before any substantial foaming (i.e. gas bubble formation) takes place. The partially foamed fine emulsion is then added to packages wherein the complete foaming takes place. This method works very well, but has the considerable commercial disadvantage that the packages must be left unsealed until foaming has finished (about 30 minutes). Moreover, the relatively slow gas generation necessitated by this method can lead to the formation of relatively large gas bubbles with diameters in excess of 200 micron. This in turn leads to lower performance.

We have now found a method for the manufacture of gas bubble-sensitized explosive compositions which provides surprisingly small gas bubbles and therefore enhanced explosive properties. We therefore provide, according to the present invention, a process for the preparation of a gas bubble-sensitized explosive composition which composition is liquid during the preparation, the process comprising the steps of (a) adding to the liquid a gas bubble-generating agent selected from the group consisting of
  (i) gases which are substantially insoluble in the composition at ambient temperature and atmospheric pressure, and
  (ii) substances capable of generating gas in situ;
(b) subjecting the liquid to conditions of super-atmospheric pressure sufficient to maintain dissolved the major proportion of any gas present in the liquid; and
(c) releasing the conditions of super-atmospheric pressure to form in the composition a discontinuous gaseous phase.

The level of super-atmospheric pressure to which the composition is subjected is dependent to a considerable extent on the nature of the composition, its components and the capability of the mixed components to absorb or dissolve the gaseous material. The level will also depend on the nature of the gaseous material. The level may thus vary with differing gaseous materials. For example, the level of super-atmospheric pressure may suitably be low, such as for example 10 kilopascals, when the gaseous component is taken up easily by the remainder of the composition; yet again with certain gases in combination with some compositions it may be necessary to use pressure say up to 50,000 kilopascals. For many combinations of composition and gaseous component in common use we have found that pressures in the range from 100 to 10,000 kilopascals and usually in the range from 500 to 5,000 kilopascals are satisfactory and may be preferred for use in the process of the present invention. Preferably the pressure applied is sufficient to dissolve and/or maintain the major portion, and more preferably essentially all, of the gaseous phase in solution. In practice it has been found that with the compositions under pressure and the gaseous component in solution the liquid explosive compositions can be pumped, mixed and worked for as long as required without any subsequent deleterious effect on the gas bubble sensitized melt explosive composition formed when the pressure is released from the liquid explosive composition.

When the conditions of super-atmospheric pressure are released in the process of the present invention, the pressure is preferably released rapidly, for example, in a few seconds or more preferably in a few milliseconds. The length of time of release and its effect on the composition is dependent on a number of factors. We have found, however, that for practical purposes, the pressure should be released as quickly as possible, and the maximum permissible time is about 1 second. In practice it has been found that the rapid release of pressure results in the formation of a discontinuous gaseous phase comprising surprisingly small bubbles which provides a gas bubble-sensitized emulsion explosive composition having improved explosive properties. Typically the size of the gas bubbles in the explosive compositions prepared according to the process of the present invention is in the range of from 20 to 200 microns. In contrast the gas bubbles present in gas bubble-sensitized explosive compositions prepared according to conventional prior art techniques are frequently outside this ideal range.

As indicated above, in the process of the present invention the rapid release of the conditions of super-atmospheric pressure has the desirable result of the formation of a discontinuous gaseous phase comprising surprisingly small gas bubbles. Therefore, preferably in the process of the present invention the gaseous component is either incorporated into the comgaseous position in the form of a gas or, if the gaseous component is incorporated into the composition in the form of a gas-generating substance, the major portion and preferably essentially all of the gas-generating substance has reacted to generate gas before the conditions of super atmospheric pressure are released.

The gas bubble-generating agent used in the process of the present invention may be selected from any of the gases or gas-generating substances conventionally used in the preparation of gas-bubble-sensitized melt explosive compositions. Thus, prior to being absorbed by or dissolved in the remainder of the composition, the gas bubble-generating agent may, for example, be dispersed into the composition by mechanical agitation, injection or bubbling gas through the composition, or by in situ generation of the gas by chemical means. Thus pressurized nitrogen or a mixture of gases such as air may be incorporated into the composition, or gas bubbles may be generated by conventional means from gas-generating substances by the decomposition for example of peroxides, such as hydrogen peroxide, or of nitrites such as sodium nitrite, or of nitrosoamines such as N,N' dinitrosopentamethylenetetramine, or of alkali metal borohydrides such as sodium borohydride or of carbonates such as sodium carbonate. From amongst chemicals for the in situ generation of gas bubbles reference is made to nitrous acid and its salts which decompose under conditions of acid pH to produce gas bubbles. Thiourea, thiocyanate or other agents may be used to accelerate the decomposition of a nitrite gassing agent.

We shall describe our invention with particular reference to emulsion explosive compositions because the results obtained with these compositions have been especially good.

We additionally provide, as a preferred embodiment of our invention a process for the preparation of a gas bubble-sensitized emulsion explosive composition which process comprises:

(a) forming a water-in-oil emulsion comprising a discontinuous aqueous phase comprising discrete droplets of an aqueous solution of inorganic oxygen-releasing salts, a continuous water-immiscible organic phase and an emulsifying agent;
(b) incorporating a discontinuous gaseous phase or a gas-generating substance into this emulsion;
(c) subjecting the emulsion to conditions of super-atmospheric pressure sufficient to dissolve at least portion of the gaseous phase or gas generated from the gas-generating substance in the emulsion; and
(d) releasing the conditions of super-atmospheric pressure to liberate the dissolved gaseous phase and form a discontinuous gaseous phase.

The emulsion explosive compositions prepared by the process of this invention may utilise the same inorganic oxidising agent, carbonaceous fuels and emulsifiers in the same proportions which are used in emulsion explosive compositions known to the art. Such compositions are described, for example, in patents such as the aforementioned U.S. patents, the disclosures of which are incorporated herein by reference. So as to facilitate understanding of our invention reference is made hereinafter to typical, but non-limiting, ingredients which may be used in compositions made by a process of our invention. Thus suitable oxygen-releasing salts for use in the aqueous phase component of the composition of the present invention include the alkali and alkaline earth metal nitrates, chlorates and perchlorates, ammonium nitrate, ammonium chlorate, ammonium perchlorate and mixtures thereof. The preferred oxygen-releasing salts include ammonium nitrate, sodium nitrate, calcium nitrate and sodium perchlorate. More preferably the oxygen-releasing salt comprises ammonium nitrate or a mixture of ammonium nitrate and sodium nitrate or calcium nitrate.

Typically, the oxygen-releasing salt component of the compositions of the present invention comprises from 40 to 95% and preferably from 60 to 90% by weight of the total composition. In compositions wherein the oxygen-releasing salt comprises a mixture of ammonium nitrate and sodium nitrate (or calcium nitrate) the preferred composition range for such a blend is up to 50 parts of sodium nitrate or 50 to 100 parts of calcium nitrate for every 100 parts of ammonium nitrate. Therefore, in preferred compositions of the present invention the oxygen-releasing salt component comprises from 60 to 90% by weight (of the total composition) ammonium nitrate, a mixture of from 0 to 30% by weight (of the total composition) sodium nitrate and from 60 to 90% by weight (of the total composition) ammonium nitrate, or a mixture of from 0 to 45% by weight (of the total composition) calcium nitrate and from 45 to 90% by weight (of the total composition) ammonium nitrate.

In the preparation of compositions of the present invention, preferably all of the oxygenreleasing salt is in aqueous solution. Typically, the amount of water employed in compositions of the present invention is in the range of from 1 to 30% by weight of the total composition. Preferably the amount employed is from 5 to 25%, and more preferably from 10 to 20%, by weight of the total composition.

The water-immiscible organic phase component of compositions of the present invention comprises the continuous "oil" phase of the water-in-oil emulsion explosive and is the carbonaceous fuel. Suitable organic fuels include aliphatic, alicyclic and aromatic compounds and mixtures thereof which are in the liquid state at the processing temperature. Suitable organic fuels may be chosen from fuel oil, diesel oil, distillate, kerosene, naptha, microcrystalline wax, paraffin wax, slack wax, paraffin oils, benzene, toluene, xylenes, asphaltic materials, polymeric oils such as the low molecular weight polymers of olefins, animal oils, fish oils, and other mineral, hydrocarbon or fatty oils, and mixtures thereof. Preferred organic fuels are liquid hydrocarbons generally referred to as petroleum distillates such as kerosene, fuel oils, paraffin oils and waxes such as paraffin wax, slack wax and microcrystalline wax or blends of waxes and liquid hydrocarbons.

Typically, the organic fuel or continuous phase of emulsion explosive compositions of the present invention comprises from 2 to 15% by weight and preferably 5 to 10% by weight of the total composition.

If desired, other optional fuel materials, hereinafter referred to as secondary fuels, may be incorporated into compositions from the present invention in addition to the water-immiscible organic fuel phase. Examples of such secondary fuels include finely divided solids, and water-miscible organic liquids which can be used to partially replace water as a solvent for the oxygen-releasing salts or to extend the aqueous solvent for the oxygen-releasing salts. Examples of solid secondary fuels include finely divided materials such as: sulfur; aluminium; and carbonaceous materials such as gilsonite, comminuted coke or charcoal, carbon black, resin acids such as abietic acid, sugars such as glucose or dextrose and other vegetable products such as starch, nut meal, grain meal and wood pulp. Examples of water-miscible organic liquids include alcohols such as methanol, glycols such as ethylene glycol, amides such as formamide and amines such as methylamine.

Typically, the optional secondary fuel component of the compositions of the present invention comprise from 0 to 30% by weight of the total composition.

Suitable emulsifiers may be chosen from a wide range of non-ionic, cationic, anionic and zwitterionic materials. Examples of emulsifiers which are suitable for use in the compositions made by the present invention include alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene)-glycol esters, fatty acid amides, fatty acid amide alkoxylates, fatty amines, quaternary amines, alkyloxazolines, alkenyloxazolines, imidazolines, alkylsulfonates, alkylarylsulfonates, alkylsulfosuccinates, alkylphosphates, alkenylphosphates and phosphate esters. Other surfactants which can usefully be used in our invention are the fluorocarbon surfactants described in our co-pending Australian patent application No. PG4650.

In these compositions made by the present invention which incorporate one or more emulsifiers, in general it is not necessary to add more than 5% by weight of emulsifier to achieve the desired effect. Higher proportions of emulsifier may be used and may serve as a supplemental fuel for the composition but for reasons of economy it is preferable to keep the amount of emulsifier used to the minimum required to have the desired effect. The preferred level of emulsifier or blend of emulsifiers is in the range from 0.1 to 2.0% and most preferably from 0.5 to 2.0% by weight of the total composition.

It is not necessary to incorporate thickening and or crosslinking agents in the emulsion explosive compositions made by the present invention to achieve stability and water resistance. However, if desired the aqueous solution of compositions made by the present invention may comprise optional thickening agent(s) which optionally may be crosslinked. The thickening agents, when used in compositions derived from the present invention, are suitably polymeric materials, especially gum materials typified by the galactomannan gums such as locust bean gum or guar gum or derivatives thereof such as hydroxypropyl guar gum. Other useful, but less preferred, gums are the so-called biopolymeric gums such as the heteropolysaccharides prepared by the microbial transformation of carbohydrate material, for example the treatment of glucose with a plant pathogen of the genus Xanthomonas typified by *Xanthomonas campestris.* Other useful thickening agents include synthetic polymeric materials and in particular synthetic polymeric materials which are derived, at least in part, from the monomer acrylamide.

Typically, the optional thickening agent component of compositions obtained by the present invention comprises from 0 to 2% by weight of the total composition.

As indicated above, when used in compositions of the present invention, the thickening agent optionally may be crosslinked. It is convenient for this purpose to use conventional crosslinking agents such as zinc chromate or a dichromate either as a separate entity or as a component of a conventional redox system such as, for example, a mixture of potassium dichromate and potassium antimony tartrate.

Typically, the optional crosslinking agent component of the compositions of the present invention comprises from 0 to 0.5% and preferably from 0 to 0.1% by weight of the total composition.

The pH of the emulsion explosive compositions made by the present invention is not narrowly critical. However, in general the pH is between 0 and 8 and preferably the pH is between 1 and 5, but most preferably between 2 and 6.

As previously mentioned, the process according to our invention gives especially good results when used to prepare emulsion explosive compositions. However, the process can be used for any other explosive composition which is sensitized by the inclusion of gas bubbles and which is liquid during its manufacture. For example, it can be used to prepare melt explosives, that is, explosives wherein an oxygen-releasing salt such as ammonium nitrate is added in melt form to a fuel. A typical example may be found in Australian patent application No. 45718/79.

The type and proportion of the materials used in non-emulsion explosives to which our invention can be applied can vary widely. For example, the previously-mentioned Australian patent application No. 45718/79 describes an explosive composition which comprises 75–95% by weight of oxidiser salt (such as ammonium nitrate), 5–12% organic fuel and 1–10% surfactant. Other explosive compositions, for example, the "microknit" explosive compositions described in Australian patent application No. 37667/85, may utilise quite different quantities and/or materials—the oxidiser salt in this case may be limited to 55% by weight of the composition, and the surfactant may comprise from 0.05% to 25% by weight of the composition and may comprise the entire fuel phase. Both of these compositions and many other explosives which are not of the emulsion type but which are liquid in the course of their manufacture can be utilised in the process according to our invention. The types and quantities of materials used will naturally depend on the type of explosive composition to be used. However, the gas bubble-generating agents which have been described previously in relation to emulsion explosive compositions will also work with non-emulsion types, and the favoured types described hereinabove are also favoured for use in non-emulsion explosive compositions.

So as to facilitate the understanding of our invention there follows a general description of an emulsion embodiment of the invention with reference to the drawings which set out flow diagrams of emulsion preparation operations for carrying out embodiments of the method of the invention. It will be appreciated that the following description refers to a general schematic arrangement of essential apparatus which, even if not mentioned specifically, comprises ancillary items such as stirring, heating, cooling or pumping means and the like. It will also be appreciated that the invention may be performed as a batch process, as well as being performed on a continuous or semicontinuous basis.

Figure 1:
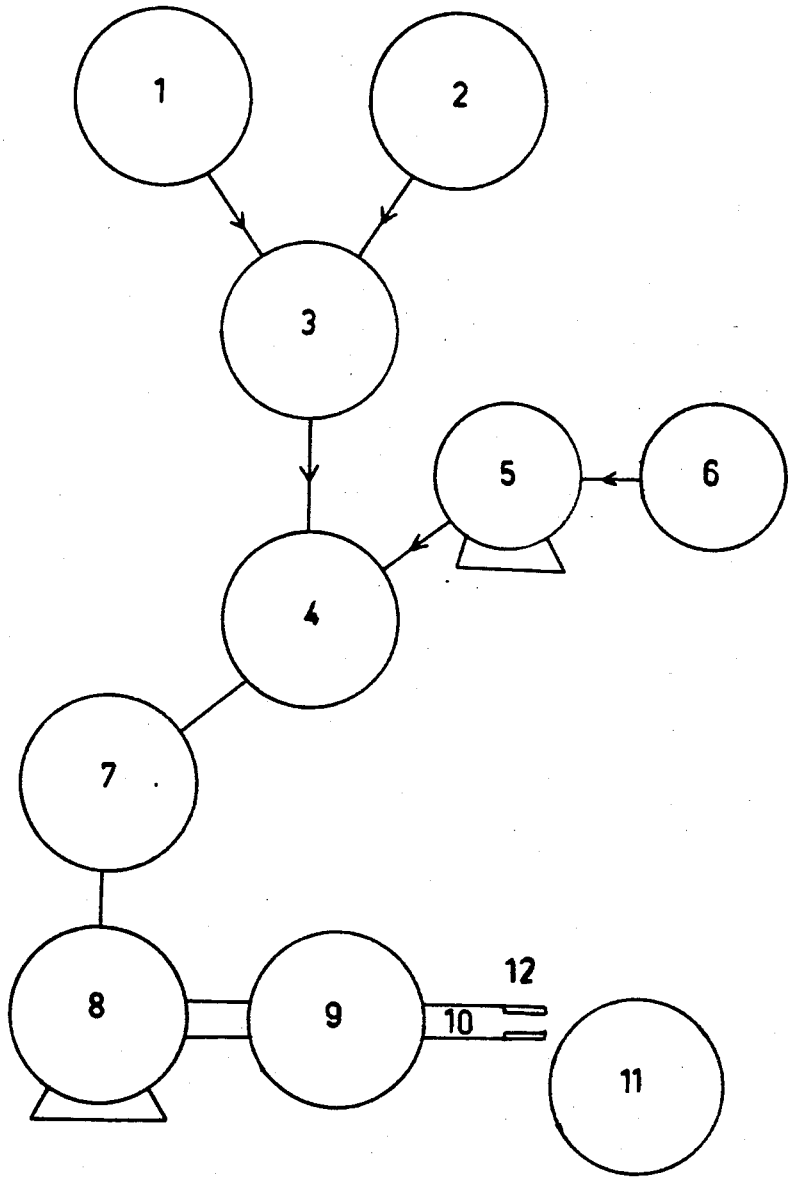
FIG. 1 shows a schematic flow diagram of an emulsion preparation operation in which the gas bubble-generating agent is added to the emulsion explosive composition before subjecting the composition to super-atmospheric pressure.

Referring to the drawings, in holding tank 1 there is prepared a hot aqueous composition comprising a major proportion of oxidizing salt material. In holding tank 2 there is a mixture of carbonaceous fuel material and emulsifying material. From each of tanks 1 and 2 is fed to blender 3 desired amounts of the aqueous composition and the mixture of fuel and emulsifier. The materials in blender 3 are subjected to a shearing force so that an essentially uniformly blended material in the form of an emulsion is obtained.

Referring to FIG. 1, the emulsion in blender 3 is then transferred to mixer 4 either for example by pumping means, not shown, or by gravitational means. Holding tank 6 contains a solution of one or more gas bubble-generating agents. The solution from tank 6 may be added to the contents of mixer 4 by gravitational means, but more usually it is so added by the use of a metering pump 5. The contents of mixer 4 and the solution added from tank 6 are blended whereupon a small amount of foaming sometimes occurs in the blend so formed. It is usually convenient to transfer the contents of mixer 4 to an optional hopper 7 from which hopper the blend is transferred to a pumping system 8. The pumping system 8 is such that during a pumping operation there is applied to the blend a super-atmospheric pressure sufficient to ensure that at least part and preferably all of the gas Which has been generated from the gas bubble-generating agent prior to the application of such pressure is dissolved in the emulsified blend and gas which is generated subsequent to the application of such pressure is dissolved directly into the emulsified blend. The product so obtained may be pumped in that state through pressure vessels such as an optional hopper 9 or one or more in-line mixers, not shown, or a conduit 10 to convey the product to its destination 11, said destination being typically a sealable package, a cartridge case or a borehole in a mining face.

Figure 2:
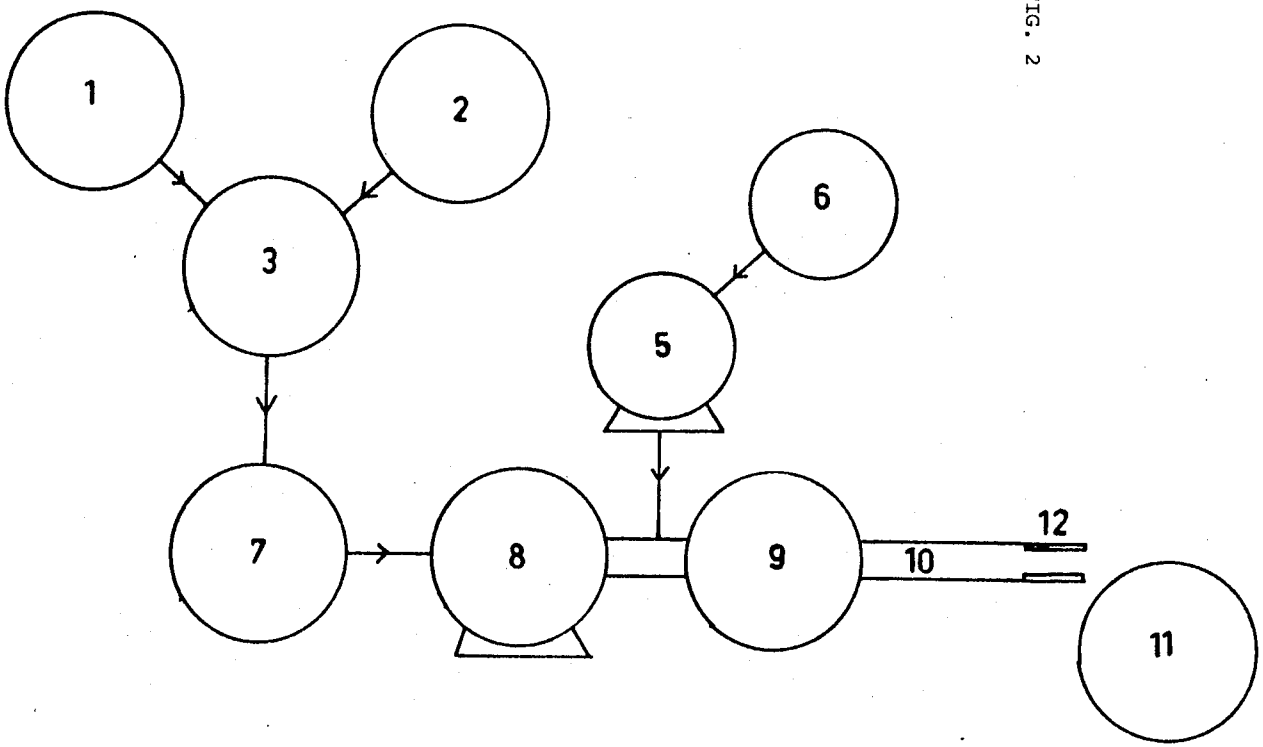
FIG. 2 shows a schematic flow diagram of an emulsion preparation operation in which the gas bubble-generating agent is added to the emulsion explosive composition while the composition is subjected to super-atmospheric pressure.

Referring to FIG. 2, the emulsion in the blender 3 is then transferred to an optional hopper 7 either for example by pumping means, not shown, or by gravitational means. From the optional hopper 7 the emulsion is transferred to a pumping system 8 wherein, during a pumping operation, there is applied to the blend a super-atmospheric pressure sufficient to ensure that at least part and preferably all of the gas to be added to or generated in the emulsion composition will dissolve in the composition. The pressurized emulsion so obtained may be pumped in that state through pressure vessels such as an optional hopper 9 or one or more in-line static mixers (not shown) or a conduit 10 to convey the product to its destination 11, said destination being typically a sealable package, a cartridge case or a borehole in a mining face. Holding tank 6 contains a solution of one or more gas bubble-generating materials which may be added to the pressurized emulsion in conduit 10 by means of a metering pump 5. The aqueous solution of gas generating material may be blended into the pressurized emulsion using one or more in-line static mixers (not shown).

It will be appreciated by those skilled in the art, that as the emulsion composition is pumped down the conduit 10 the super-atmospheric pressure in the conduit 10 inevitably reduces. In order to minimize this pressure reduction it has been found useful to have a constriction 12 in the conduit 10 so as to reduce the bore of conduit 10 in the region of its open end remote from pumping system 8. Thus the bore of conduit 10 may be tapered over the final few centimeters of its length. Yet again a series of inline mixers may be inserted into the hose so as to reduce the internal volume of part of the conduit 10 by say 50%. Still further we have found that an efficacious constriction 12 in the bore of the conduit 10 may be effected by for example inserting inside the final few centimeters of conduit 10 a hollow metal shaft which effectively reduces the internal diameter of the conduit by say 75%.

The equipment used in the process described above is of the type conventionally used for preparing and transferring explosive compositions. The choice of particular items is dependent on the nature of the composition required for a designated end purpose. Thus for example if a high viscosity product is required it may be desirable to use as mixer 4 a high shear device. Yet again pumping system 8 may comprise only one pumping unit when the superatmospheric pressure value is relatively low, but it may be necessary to provide a multiplicity of pumping units when high pressures are required.

The invention is now illustrated by but is not limited to the following examples in which all parts and percentages are expressed on a weight basis. To facilitate the description reference is made to FIG. 1 in regard to the identification of apparatus used in the invention, except in the case of Example 7 wherein the apparatus of FIG. 2 is used. Example 2 is included for the purpose of comparison and does not fall within the scope of the invention.

EXAMPLE 1

In holding tank 1 an aqueous composition was prepared by mixing 7120 parts of ammonium nitrate, 400 parts of sodium nitrate, 1740 parts of water, 10 parts of thiourea, 10 parts of sodium acetate and 10 parts of acetic acid. The composition was heated to a temperature of 70° C. In holding tank 2 a mixture of 600 parts of paraffin oil and 100 parts of sorbitan mono-oleate was prepared at room temperature. The contents of tank 1 were fed to blender 3 at a rate of 27.9 kilograms per minute at the same time as the contents of tank 2 were fed to blender 3 at a rate of 2.1 kilograms per minute.

The emulsion so formed was pumped into mixer 4 at a rate of 30 kilograms per minute. In holding tank 6 there was prepared an aqueous solution containing 20% sodium nitrite and this was metered into the emulsion in mixer 4 at a rate of 43 grams per minute. The treated emulsion was fed into hopper 7 and then to a 'Mono' pump 8 of the progressive cavity type which pumped the emulsion at a pumping pressure of 900 kilopascals through 15 meters of a reinforced flexible hose 10 having an internal diameter of 25 millimeters. The hose 10 had been modified over the last 10 centimeters of its length most remote from pump 8 by the insertion into the hose 10 of a 10 centimeters long hollow metal tube so that a constriction 12 occurred in hose 10 and the effective internal diameter of hose 10 through which the emulsion could pass prior to leaving hose 10 was reduced to 6 millimeters. When the emulsified product was forced from the modified end of hose 10, it flowed to a cartridge case 11 and almost immediately commenced to foam. After a further 7 minutes it was observed that foaming of the emulsion had ceased. Samples were taken of the emulsion explosive composition and these were placed on microscope slides, photographed and the average bubble size in the foamed emulsified product was measured. The average diameter of the bubbles so obtained was 160 microns.

The velocity of detonation of the emulsion at a density of 1.16 g/cc in 750 mm long×130 mm diameter card board tubes was 4.5 km/sec.

EXAMPLE 2

The general procedure of Example 1 was repeated except that in the present example no metal tube was inserted into hose 10. The average diameter of the bubbles so obtained was 370 microns.

The velocity of detonation of the emulsion at a density of 1.16 g/cc in 750 mm long×130 mm diameter card board tubes was 5.7 km/sec.

EXAMPLE 3

The procedure described in Example 1 was repeated except that the emulsion was pumped through 5 meter length of a hose 10 having an internal diameter of 50 mm. The end of the hose was fitted with an adaptor to which was attached a 10 cm long nozzle having an internal diameter of 22 mm.

The average diameter of the bubbles in the emulsion produced thereby was 172 micron.

EXAMPLE 4

The general procedure of Example 3 was repeated except that in this example there was no restriction on the end of the hose. The average diameter of the bubbles in the emulsion produced thereby was 329 micron.

EXAMPLE 5

The general procedure of Example 3 was repeated except in this example a nozzle having an internal diameter of 16 mm was fitted. The average diameter of the bubbles in the emulsion produced thereby was 123 micron.

EXAMPLE 6

The general procedure of Example 5 was repeated, except that the nozzle had an internal diameter of 13 mm. The average diameter of the bubbles in the emulsion produced thereby was 116 micron.

EXAMPLE 7

An example illustrating the use of a pre-formed emulsion and the addition of gas bubble-generating agent.

The following ingredients were mixed as described in Example 1 to form an emulsion:

| | |
|---|---|
| ammonium nitrate | 7595 parts |
| water | 1900 |
| sodium acetate | 10 |
| acetic acid | 10 |
| distillate | 400 |
| sorbitan mono-oleate | 80 |
| fluorocarbon surfactant* | 2 |

*"Fluorad" (trade mark) FC 740 ex Minnesota Mining and Manufacturing Co.

The resulting emulsion was pumped to a hopper. This was then pumped out at a rate of 100 kg/min. at a pumping pressure of 100 kPa through a 50 mm diameter reinforced flexible Hose, the last 10 cm of this Hose being equipped with a metal tube of the type described in Example 1, except that it had an internal diameter of 22 mm.

Immediately after leaving the pump, the pressurised emulsion had pumped into it by compressed air an aqueous solution of 15% sodium nitrite and 30% sodium thiocyanate. The mixture was then passed through a series of static mixers (not shown on FIG. 2) before exiting from the Hose.

This method has the considerable advantage that the non-"gassed" emulsion can be carried to where it is needed, for example, on a vehicle, and then "gassed" in-situ and fed straight into blast holes.

EXAMPLE 8

Use of the invention in a "melt" explosive composition.

A non aqueous melt emulsion was prepared by adding 697 parts of ammonium nitrate, 160 parts of sodium nitrate, 143 parts of urea, 1 part of sodium acetate, and 1 part acetic acid to holding tank 1. The composition was heated to 130° C. and held there until a clear melt free of all solid material was obtained. In holding tank 2 a mixture of 20 parts of paraffin oil, 20 parts of paraffin wax, 20 parts of sorbitan sesqui-oleate ("Arlacel" (trade mark) 83 ex Atlas Chemical Industries N.V.) and 20 parts of soya lecithin was prepared at 130° C. The contents of tank 2 were transferred to blender 3 and then the melt from tank 1 was slowly added with stirring over a 15 minute period to form an emulsion.

The emulsion was allowed to cool to 70° C. and then mixed with 2.2 parts of an aqueous solution containing 15% sodium nitrite and 30% sodium thiocyanate. The resulting emulsion was then "gassed" using the equipment and according to the method of Example 1 to give results similar to that example.

We claim:

1. A process for the preparation of a gas bubblesensitized explosive composition which composition is liquid during the preparation, the process comprising the addition to the liquid of a gas bubblegenerating agent selected from the group consisting of (i) gases which are substantially insoluble in the liquid at ambient temperature and pressure, and (ii) substances capable of generating such gases in situ, characterised in that (a) the liquid is subjected to conditions of super-atmospheric pressure such that the major portion of any gas present in or added to the liquid is dissolved; and (b) the conditions of super-atmospheric pressure are rapidly released to form in the composition a discontinuous gaseous phase.

2. A process according to claim 1, characterised in that the gas bubble-generating agent is added to the liquid prior to subjecting it to conditions of super-atmospheric pressure.

3. A process according to claim 1, characterised in that the gas bubble-generating agent is added to the liquid when it is under conditions of super-atmospheric pressure.

4. A process according to any one of claims 1 to 3, characterised in that the super-atmospheric pressure is released during a period of a few seconds.

5. A process according to any one of claims 1 to 3, characterised in that the super-atmospheric pressure is released during a period of 1 second maximum.

6. A process according to any one of claims 1 to 4, characterised in that the super-atmospheric pressure is released during a period of a few milliseconds.

7. A process according to any one of claims 1 to 3, characterised in that the super-atmospheric pressure is 50,000 kilopascals maximum.

8. A process according to any one of claims 1 to 3, characterised in that the super-atmospheric pressure is from 100–10,000 kilopascals.

9. A process according to any one of claims 1 to 3, characterised in that the super-atmospheric pressure is from 500–5,000 kilopascals.

10. A process according to any one of claims 1–3, characterised in that the gas bubble-generating agent is a gas selected from nitrogen and air.

11. A process according to any one of claims 1–3, characterised in that the gas bubble-generating agent is a substance capable of generating gas, selected from the group consisting of peroxides, nitrites, nitrosamines, alkali metal borohydrides, carbonates and nitrous acid and its salts.

12. A process according to claim 11, characterised in that the gas bubble-generating agent is selected from the group consisting of hydrogen peroxide, sodium nitrite, N,N[1]-dinitroso-pentamethylenetetramine, sodium borohydride and sodium carbonate.

13. An explosive composition produced by a process according to claim 1.

14. A process for the preparation of a gas bubble-sensitized emulsion explosive composition which process comprises forming a water-in-oil emulsion comprising a discontinuous aqueous phase comprising discrete droplets of an aqueous solution of inorganic oxygen-releasing salts, a continuous water-immiscible organic phase, an emulsifying agent and a discontinuous gaseous phase, the gaseous phase being provided by a gas bubble-generating agent selected from (i) gases which are substantially insoluble in the liquid at ambient temperature and pressure, and (ii) substances capable of generating such gas in situ, characterised in that (a) the composition is subjected to conditions of super-atmospheric pressure sufficient to dissolve at least portion of said gaseous phase; and (b) the said conditions of super-atmospheric pressure are released to liberate the dissolved gaseous phase and form a discontinuous gaseous phase.

15. A process according to claim 14, characterised in that the gas bubble-generating agent is added to the liquid prior to subjecting it to conditions of super-atmospheric pressure.

16. A process according to claim 14, characterised in that the gas bubble-generating agent is added to the liquid when it is under conditions of super-atmospheric pressure.

17. A process according to any one of claims 14 to 16, characterised in that the super-atmospheric pressure is released during a period of a few seconds.

18. A process according to any one of claims 14 to 16, characterised in that the super-atmospheric pressure is released during a period of 1 second maximum.

19. A process according to any one of claims 14 to 16, characterised in that the super-atmospheric pressure is released during a period of a few milliseconds.

20. A process according to any one of claims 14 to 16, characterised in that the super-atmospheric pressure is 50,000 kilopascals maximum.

21. A process according to any one of claims 14 to 16, characterised in that the super-atmospheric pressure is from 100–10,000 kilopascals.

22. A process according to any one of claims 14 to 16, characterised in that the super-atmospheric pressure is from 500–5,000 kilopascals.

23. A process according to any one of claims 14 to 16, characterised in that the gas bubble-generating agent is a gas selected from nitrogen and air.

24. A process according to any one of claims 14 to 16, characterised in that the gas bubble-generating agent is a substance capable of generating gas, selected from the group consisting of peroxides, nitrites, nitrosamines, alkali metal borohydrides, carbonates and nitrous acid and its salts.

25. A process according to claim 24, characterised in that the gas bubble-generating agent is selected from the group consisting of hydrogen peroxide, sodium nitrite, N,N'-dinitroso-pentamethylenetetramine, sodium borohydride and sodium carbonate.

26. A process according to any one of claims 14 to 16, characterised in that the oxygen-releasing salt is selected from the group consisting of ammonium nitrate, mixtures of ammonium nitrate and sodium nitrate, and mixtures of ammonium nitrate and calcium nitrate.

27. A process according to claim 26, characterised in that oxygen-releasing salt comprises from 40 to 95% by weight of the explosive composition.

28. A process according to claim 26, characterised in that oxygen-releasing salt comprises from 60 to 90% by weight of the explosive composition.

29. A process according to claim 26, characterised in that when a mixture is used, there shall be present up to 50 parts sodium nitrate and from 50 to 100 parts calcium nitrate for every 100 parts of ammonium nitrate.

30. A process according to any one of claims 14 to 16, characterised in that the oxygen-releasing salt is in aqueous solution.

31. A process according to any one of claims 14 to 16, characterised in that water comprises from 1–30% by weight of the explosive composition.

32. A process according to any one of claims 14 to 16, characterised in that water comprises from 5 to 25% by weight of the explosive composition.

33. A process according to any one of claims 14 to 16, characterised in that water comprises from 10 to 20% by weight of the explosive composition.

34. A process according to any one of claims 14 to 16, characterised in that the continuous organic phase comprises from 2 to 15% by weight of the explosive composition.

35. A process according to any one of claims 14 to 16, characterised in that the continuous organic phase comprises from 5–10% by weight of the explosive composition.

36. A process according to any one of claims 14 to 16, characterised in that the pH of the explosive composition lies in the range of from 0 to 8.

37. A process according to any one of claims 14 to 16, characterised in that the pH of the explosive composition lies in the range of from 1 to 5.

38. A process according to any one of claims 14 to 16, characterised in that the pH of the explosive composition lies in the range of from 2 to 6.

39. An emulsion explosive composition produced by a process according to claim 14.

* * * * *